US011105347B2

(12) United States Patent
Rannow

(10) Patent No.: US 11,105,347 B2
(45) Date of Patent: Aug. 31, 2021

(54) LOAD-DEPENDENT HYDRAULIC FLUID FLOW CONTROL SYSTEM

(71) Applicant: Eaton Intelligent Power Limited, Dublin (IE)

(72) Inventor: Michael Berne Rannow, Eden Prairie, MN (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 229 days.

(21) Appl. No.: 16/038,506

(22) Filed: Jul. 18, 2018

(65) Prior Publication Data

US 2019/0024677 A1 Jan. 24, 2019

Related U.S. Application Data

(60) Provisional application No. 62/534,924, filed on Jul. 20, 2017.

(51) Int. Cl.
*F15B 11/16* (2006.01)
*F15B 13/02* (2006.01)
(Continued)

(52) U.S. Cl.
CPC ..... *F15B 11/161* (2013.01); *E02F 9/2012* (2013.01); *E02F 9/2203* (2013.01);
(Continued)

(58) Field of Classification Search
CPC ..... F15B 2211/6313; F15B 2211/6346; F15B 2211/40553; F15B 2211/40561;
(Continued)

(56) References Cited

U.S. PATENT DOCUMENTS 4,031,813 A 6/1977 Walters et al.
4,938,252 A * 7/1990 Piechnick ..... G05D 16/2013 137/486
(Continued)

FOREIGN PATENT DOCUMENTS

JP 2007205464 A 8/2007
JP 2007278457 A 10/2007
WO 2009/145682 A1 12/2009

OTHER PUBLICATIONS

Parker Hannifin Catalogue HY17-8504/UK, L90LS Mobile Directional Control Valve brochure, 2010, 44 pages total.
(Continued)

*Primary Examiner* — Dustin T Nguyen
(74) *Attorney, Agent, or Firm* — Merchant & Gould P.C.

(57) ABSTRACT

The present disclosure relates to a load dependent flow control system for directing hydraulic fluid to a hydraulic actuator. The load dependent flow control system includes a closed-center valve device for controlling hydraulic fluid flow to the actuator. The closed-center valve device includes a valve spool and an electro-actuator that adjusts a position of the valve spool to adjust a rate of the hydraulic fluid flow supplied to the hydraulic actuator. A pressure sensor is provided for sensing a pressure of the hydraulic fluid provided to the hydraulic actuator. The system also includes an electronic controller configured to receive an operator flow command from an operator interface. The operator flow command corresponds to a base flow through the closed-center valve device. The electronic controller interfaces with the electro-actuator of the closed-center valve device and with the pressure sensor. At least when the sensed pressure is above a threshold pressure, the electronic controller uses the operator flow command and the sensed pressure to generate a pressure-modified flow command that is sent to the closed-center valve device to control flow through the
(Continued)

closed-center valve device. The pressure-modified flow command corresponds to a pressure-modified flow through the closed-center valve device. The pressure-modified flow is less than the base flow through the closed-center valve device.

7 Claims, 13 Drawing Sheets

(51) Int. Cl.
*F15B 21/08* (2006.01)
*E02F 9/22* (2006.01)
*E02F 9/20* (2006.01)

(52) U.S. Cl.
CPC ..... *E02F 9/2235* (2013.01); *F15B 11/165* (2013.01); *F15B 13/026* (2013.01); *F15B 21/082* (2013.01); *F15B 21/087* (2013.01); *F15B 2211/20546* (2013.01); *F15B 2211/20553* (2013.01); *F15B 2211/3057* (2013.01); *F15B 2211/3111* (2013.01); *F15B 2211/327* (2013.01); *F15B 2211/405* (2013.01); *F15B 2211/426* (2013.01); *F15B 2211/6054* (2013.01); *F15B 2211/6313* (2013.01); *F15B 2211/6346* (2013.01); *F15B 2211/6652* (2013.01); *F15B 2211/6658* (2013.01)

(58) Field of Classification Search
CPC ..... F15B 2211/40569; F15B 2211/413; F15B 2211/465; F15B 2211/653; F15B 2211/665; F15B 2211/6656; F15B 2211/6654; F15B 2211/6653; F15B 2211/3111; F15B 2211/3144; F15B 2211/327; F15B 2211/351; F15B 11/161; F15B 13/026; F15B 21/087
USPC ..... 60/462
See application file for complete search history.

(56) References Cited

U.S. PATENT DOCUMENTS 5,182,908 A * 2/1993 Devier ..... E02F 9/2221 60/420
5,261,234 A * 11/1993 Holloway ..... E02F 9/2228 137/625.65
6,286,412 B1 * 9/2001 Manring ..... E02F 9/2228 91/433
6,321,152 B1 * 11/2001 Amborski ..... E02F 9/2221 60/422
6,557,277 B1 * 5/2003 Hibi ..... E02F 3/4135 37/187
6,725,131 B2 * 4/2004 Lunzman ..... G05D 7/0635 137/1
7,007,466 B2 * 3/2006 Price ..... F15B 11/08 60/431
7,146,808 B2 * 12/2006 Devier ..... E02F 9/2246 60/422
8,751,114 B2 * 6/2014 Filla ..... E02F 9/2221 701/50
8,869,520 B2 * 10/2014 Vigholm ..... F15B 11/162 60/422
9,032,724 B2 * 5/2015 Pfaff ..... E02F 9/2292 60/428
9,441,348 B1 * 9/2016 Alig ..... E02F 9/2228
10,161,423 B2 * 12/2018 Rampen ..... F15B 11/17
10,183,852 B2 * 1/2019 Das ..... B66F 9/22
10,408,238 B2 * 9/2019 Wang ..... F15B 21/085
2002/0087244 A1 * 7/2002 Dix ..... E02F 9/2228 701/50
2004/0011192 A1 * 1/2004 Frediani ..... F15B 11/006 91/459
2011/0000203 A1 * 1/2011 Riedel ..... F15B 11/163 60/327
2011/0240147 A1 * 10/2011 Yun ..... E02F 9/2235 137/487.5
2012/0067432 A1 * 3/2012 Vigholm ..... E02F 9/2296 137/14
2016/0145835 A1 * 5/2016 Kim ..... E02F 9/2285 60/327
2017/0276155 A1 * 9/2017 Hijikata ..... E02F 9/22

OTHER PUBLICATIONS

CMX Y Pressure Control Spool, 7 total pages.
Kurt R. Lonnemo, CMX Y4 Inertia Control Spool, Oct. 1989, 11 total pages.
Eaton Brand Medium Duty Piston Pumps, Load Sensing Systems Principle of Operation, Nov. 1992, 28 total pages.
Extended European Search Report for Application No. 18184585.0 dated Nov. 19, 2018.
European Office Action for Application No. 18184585.0 dated Mar. 20, 2020.

* cited by examiner

LOAD-DEPENDENT HYDRAULIC FLUID FLOW CONTROL SYSTEM

CROSS-REFERENCE TO RELATED APPLICATION

This application claims the benefit of U.S. Provisional Patent Application Ser. No. 62/534,924 filed Jul. 20, 2017, the disclosure of which is hereby incorporated by reference in its entirety.

TECHNICAL FIELD

The present disclosure relates generally to flow control systems for controlling hydraulic fluid flow used for driving one or more hydraulic actuators. More particularly, the present disclosure relates to flow control systems including closed-center valve devices.

BACKGROUND

Flow control systems include valve devices for controlling hydraulic fluid flow within a hydraulic system. A typical valve device has a variable-sized orifice, the orifice area of which can be varied by movement of a valve spool or other structure to vary (e.g., meter) the flow rate of hydraulic fluid provided to and/or from a hydraulic actuator. Valve devices can also be used to reverse the direction of hydraulic fluid flow through an actuator to reverse the direction of movement of the actuator. Example actuators include hydraulic cylinders and hydraulic motors. Common types of valve devices include open-center valve devices and closed-center valve devices.

FIG. 1 illustrates an example hydraulic system including a prior art open-center valve device 20 for controlling the rate of hydraulic fluid flow provided to and from an actuator (e.g., a hydraulic cylinder 22) and for proving directional flow control. The hydraulic cylinder 22 includes a cylinder body 24 and a piston 26 that is reciprocated back and forth within the cylinder body 24 via pressurized hydraulic fluid provided to the cylinder body 24 by the open-center valve device 20. The piston 26 includes a piston head 27 and a piston rod 28 carried with the piston head 27. The cylinder body 24 defines first and second cylinder ports 30, 32 that are respectively in fluid communication with first and second valve ports 34, 36 of the open-center valve device 20. The open-center valve device 20 also includes third and fourth valve ports 38, 40 that are respectively in fluid communication with a hydraulic pump 42 and a tank 44 (i.e., a reservoir). The open-center valve device 20 includes a valve spool 45 or other type of valve body that reciprocates axially within a valve sleeve 47 defining the valve ports 34, 36, 38 and 40. The valve sleeve 47 can be formed by a valve housing. The valve spool 45 of the open-center valve device 20 includes a left section 46, a center section 48 and a right section 50 each defining different flow paths. By moving the valve spool 45 axially within the valve sleeve 47, the flow paths of the different sections can selectively be placed in fluid communication with the valve ports 34, 36, 38 and 40. By varying the degree of alignment between the flow paths of the sections 46, 48 and 50 and the valve ports 34, 36, 38 and 40, orifice sizes (e.g., the cross-sectional area or areas of an orifice or orifices defined by the valve) of the valve can be varied to meter/vary flow rate through the valve. When valve spool 45 is positioned such that the flow paths of the left section 46 of the valve spool 45 are in fluid communication with the with the valve ports 34, 36, 38 and 40, the first cylinder port 30 is placed in fluid communication with the tank 44 and the second cylinder port 32 is placed in fluid communication with the high pressure side of the pump 42 thereby causing the piston 26 to be driven in a first direction 52. When the valve spool 45 is positioned such that the flow paths of the right section 50 of the open-center valve device 20 are in fluid communication with the valve ports 34, 36, 38 and 40, the second cylinder port 32 is placed in fluid communication with tank 44 and the first cylinder port 30 is placed in fluid communication with the high pressure side of the hydraulic pump 42 causing the piston 26 to move in a second direction 54 relative to the cylinder body 24. When the valve spool 45 is positioned such that the flow paths of the center section 48 of the open-center valve device 20 are in fluid communication with the valve ports 34, 36, 38 and 40 (as shown at FIG. 1), the high pressure side of the pump 42 as well as the first and second cylinder ports 30, 32 are placed in fluid communication with tank 44. Open-center valve devices are configured such that the parallel, open-center flow path arrangement provided by the center section 48 is capable of diverting flow away from the load on the hydraulic cylinder 22 (e.g., to tank) at higher pressures.

FIG. 2 shows a closed-center valve device 60 incorporated into the hydraulic system of FIG. 1. The closed-center valve device 60 includes a valve spool 61 with a left section 62, a center section 64 and a right section 66. The left section 62 and the right section 66 control flow to the hydraulic cylinder 22 in the same way described above with respect to the left section 46 and the right section 50 of the open-center valve device 20 of FIG. 1. However, the center section 64 of the closed-center valve device 60 is different from the center section 48 of the open-center valve device 20. Rather than providing a parallel, open-center flow path like the center section 48 of the open-center valve device 20, the center section 64 of the closed-center valve device 60 has a closed (e.g., blocked, terminated, blind, stopped) configuration adapted to block the valve ports 34, 36, 38 and 40. When the valve spool 61 is in a position where the center section 64 is aligned with the valve ports 34, 36, 38 and 40, the valve ports 34, 36, 38 and 40 are blocked such that the cylinder ports 30, 32 as well as the valve ports 34, 36 are not in fluid communication with either the high pressure side of the pump 42 or the tank 44. Thus, unlike open-center valve devices, closed-center valve devices are not capable of diverting flow to tank in response to higher load pressures.

SUMMARY

Closed-center valve systems are generally more efficient than the open-center valve control systems used in many off-road machines (e.g., excavators, drills). However, in open-center systems, the speed of the load (e.g., the speed of the actuator such as the speed of a driven piston within a cylinder or the speed of a driven motor) is a function of both an operator flow command and the load pressure. This is due to the parallel, open center flow path of the open-center valve structure that is configured to divert flow away from the load at high pressures. This gives the operator visual feedback about the force of the load, since the actuator slows down in a visually perceptible way as the load increases. Aspects of the present disclosure relate to load-dependent flow control systems that provide a load-dependent feel for flow control systems including closed-center valve devices. In certain examples, the load-dependent feel can mimic (e.g., match, imitate) the load-dependent feel provided by flow control systems including open-center valve devices. Thus, aspects of the present disclosure relate to flow control systems having efficiencies of the type associated with closed-center valve systems while also having a load-dependent "feel" of the type typically associated with open-center valve control systems.

In a typical closed-center valve control system (e.g., a load-sense system), an operator flow command which is input by an operator through an operator interface correlates directly to a corresponding flow rate, regardless of the load pressure. Aspects of the present disclosure relate to using a pressure sensor at the actuator to sense load pressure, and to using the sensed load pressure to convert the operator flow command according to some specified function (e.g., a linear function dependent upon sensed load pressure, a curved or exponential function dependent upon sensed load pressure, a function that corresponds to a virtual center orifice function, etc.) to a pressure-modified flow command. The pressure-modified flow command can correspond to a flow rate which is less than the flow rate which would have been established had the operator flow command not been modified. The reduction in flow rate can be directly related to sensed pressure (e.g., higher pressures result in larger reductions in flow rate as compared to lower pressures). In other words, the higher the sensed pressure, the more the operator flow command is reduced. Thus, through the pressure-based command modification, a given operator flow command will result in a lower flow rate at a higher sensed pressure as compared to a lower sensed pressure. In some examples, the pressure-based command modification is only implemented once the sensed pressure reaches or exceeds a threshold pressure. The form of the pressure-dependent flow rate modification function can vary widely, and can be tuned for different original equipment manufacturers (OEMs), operators, soil conditions, etc. This will allow a customized and tunable "feel" for the valve using efficient, closed-center valves. Beyond creating a different "feel", aspects of the present disclosure can be used in applications such as mining or other applications, where it is desirable to slow down an actuated element when the actuated element encounters harder applications. For example, for mining applications including drilling, it is desirable to reduce the speed of a drill when harder rock is encountered to protect the drill bit or other components of the drill.

Aspects of the present disclosure can relate to a flow control system including an electro-hydraulic flow control valve (e.g., a closed-center valve) and load pressure sensors. An electronic controller can use sensed data from the load pressure sensors to implement a control strategy that mimics a load-dependent feel by reducing the flow demand to the valve based on the magnitude of the load pressure measured at the actuator. In certain examples, this approach can be used on independent metering valves. The approach can be used in flow control systems including load-sense protocol that can be mechanically compensated, electronically compensated, or compensated via a hybrid system that includes a combination of electronics and hydraulics. In certain examples, aspects of the present disclosure relate to a hydraulic control system capable of converting an operator demand from a pure flow command to something closer to a power command.

Aspects of the present disclosure also relate to a hydraulic flow control system having flow-demand modification that can be tunable for different machines, services, operators and/or conditions. For example, the flow-demand modification can be tuned for different operators that might prefer a softer or stiffer feel. The flow-demand modification can also be tuned so that different machine OEMs can use a single valve to provide different, custom feels. In certain examples, flow-demand modification can be adjusted or tuned based on different applications or operating conditions (e.g., soil types).

Aspects of the present disclosure can also be used to limit power demand at individual actuators and across the entire hydraulic system. By limiting the flow demand to a particular service based on pressure, the power to a single service can be capped. By setting power caps for all of the services in the system, the power demand for the entire system can be limited/capped. In one example, the control system operates such that the flow provided to a service will not exceed the maximum power allocated to the service divided by the sensed pressure corresponding to the load at the service. In cases where the pressure is low (e.g., below a pre-set threshold), the flow provided to a service can be set directly by the operator flow command. In cases where the pressure is higher, the flow can be established through a pressure-based command modification protocol that reduces the operator flow command taking into consideration sensed pressure as well as the maximum power allocated to the service. A supervisory controller can communicate with all services and can limit the total power (or torque) of the system. In certain examples, flow to certain valves can be prioritized over other valves.

Another aspect of the present disclosure relates to a load dependent flow control system for directing hydraulic fluid to a hydraulic actuator. The load dependent flow control system includes a closed-center valve device for controlling hydraulic fluid flow to the actuator. The closed-center valve device includes a valve spool and an electro-actuator that adjusts a position of the valve spool to adjust a rate of the hydraulic fluid flow supplied to the hydraulic actuator. The load dependent flow control system also includes a pressure sensor for sending a pressure of the hydraulic fluid provided to the hydraulic actuator. The load dependent flow control system further includes an electronic controller configured to receive an operator flow command from an operator interface. The electronic controller interfaces with the electro-actuator of the closed-center valve device and with the pressure sensor. At least when the sensed pressure is above a predetermined threshold level, the electronic controller is configured to modify the operator flow command based on sensed pressure to convert the operator flow command into a pressure-based flow command. The pressure-based flow command dictates a position of the valve spool and a corresponding flow rate through the closed-center valve device. The pressure-based flow command is dependent upon and variable with the sensed pressure. In one example, to generate the pressure-based flow command, the operator flow command is modified by reducing the operator flow command in direct dependency with a magnitude of the sensed pressure. When such a flow command modification protocol is in effect, the flow rate through the closed-center valve device for a given operator flow command is indirectly dependent upon the magnitude of the sensed pressure of the actuator load.

A further aspect of the present disclosure relates to a load dependent flow control system for directing hydraulic fluid to a hydraulic actuator. The load dependent flow control system includes a closed-center valve device for controlling hydraulic fluid flow to the actuator. The closed-center valve device includes a valve spool and an electro-actuator that adjusts a position of the valve spool to adjust a rate of the hydraulic fluid flow supplied to the hydraulic actuator. A pressure sensor is provided for sensing a pressure of the hydraulic fluid provided to the hydraulic actuator. The system also includes an electronic controller configured to receive an operator flow command from an operator interface. The operator flow command corresponds to a base flow through the closed-center valve device. The electronic controller interfaces with the electro-actuator of the closed-center valve device and with the pressure sensor. At least when the sensed pressure is above a threshold pressure, the electronic controller uses the operator flow command and the sensed pressure to generate a pressure-modified flow command that is sent to the closed-center valve device to control flow through the closed-center valve device. The pressure-modified flow command corresponds to a pressure-modified flow through the closed-center valve device. The pressure-modified flow is less than the base flow through the closed-center valve device.

A variety of additional aspects will be set forth in the description that follows. The aspects can relate to individual features and to combinations of features. It is to be understood that both the forgoing general description and the following detailed description are exemplary and explanatory only and are not restrictive of the broad concepts upon which the examples disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Figure 1:
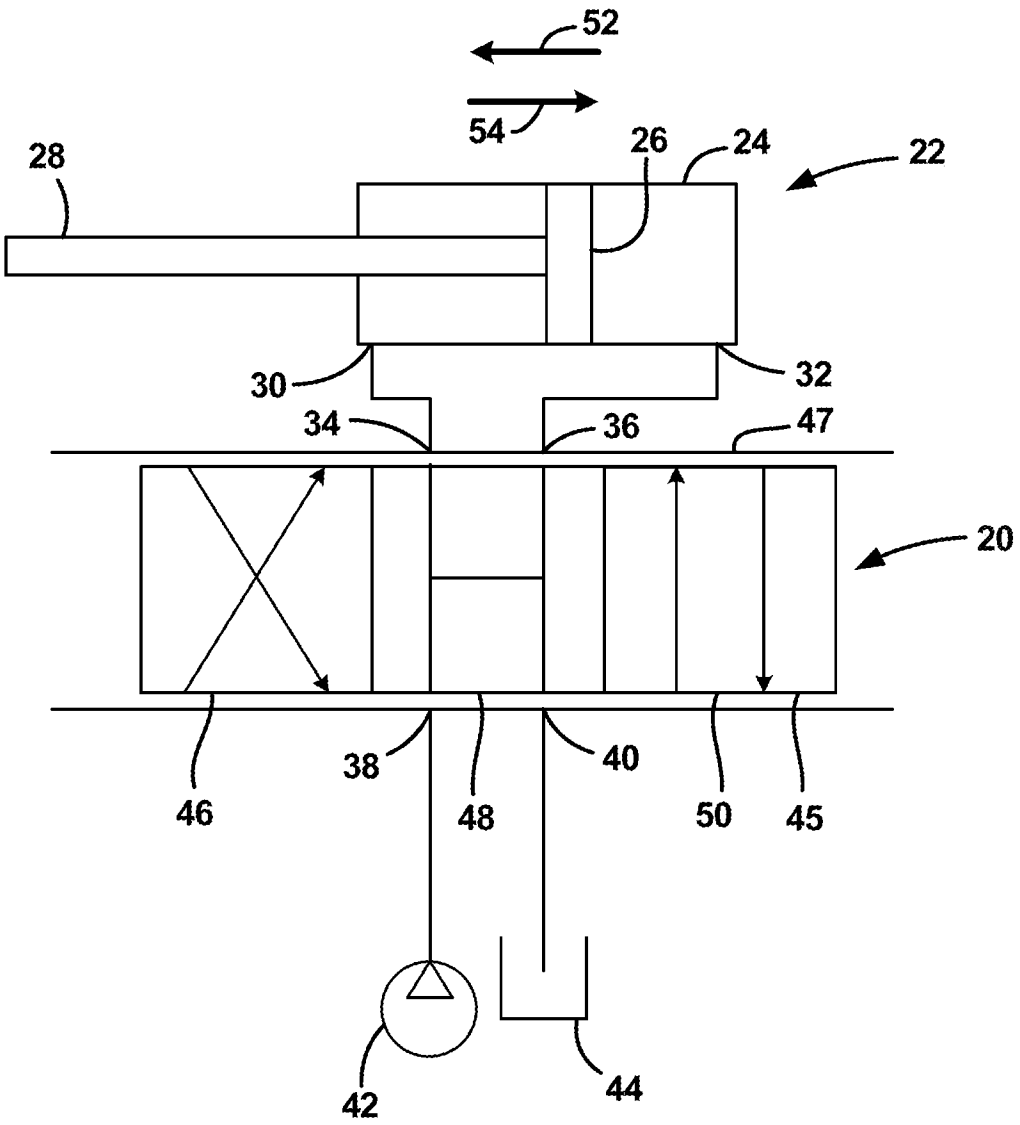
FIG. 1 (PRIOR ART)
FIG. 1 illustrates a prior art hydraulic system including an open-center valve device.
Figure 2:
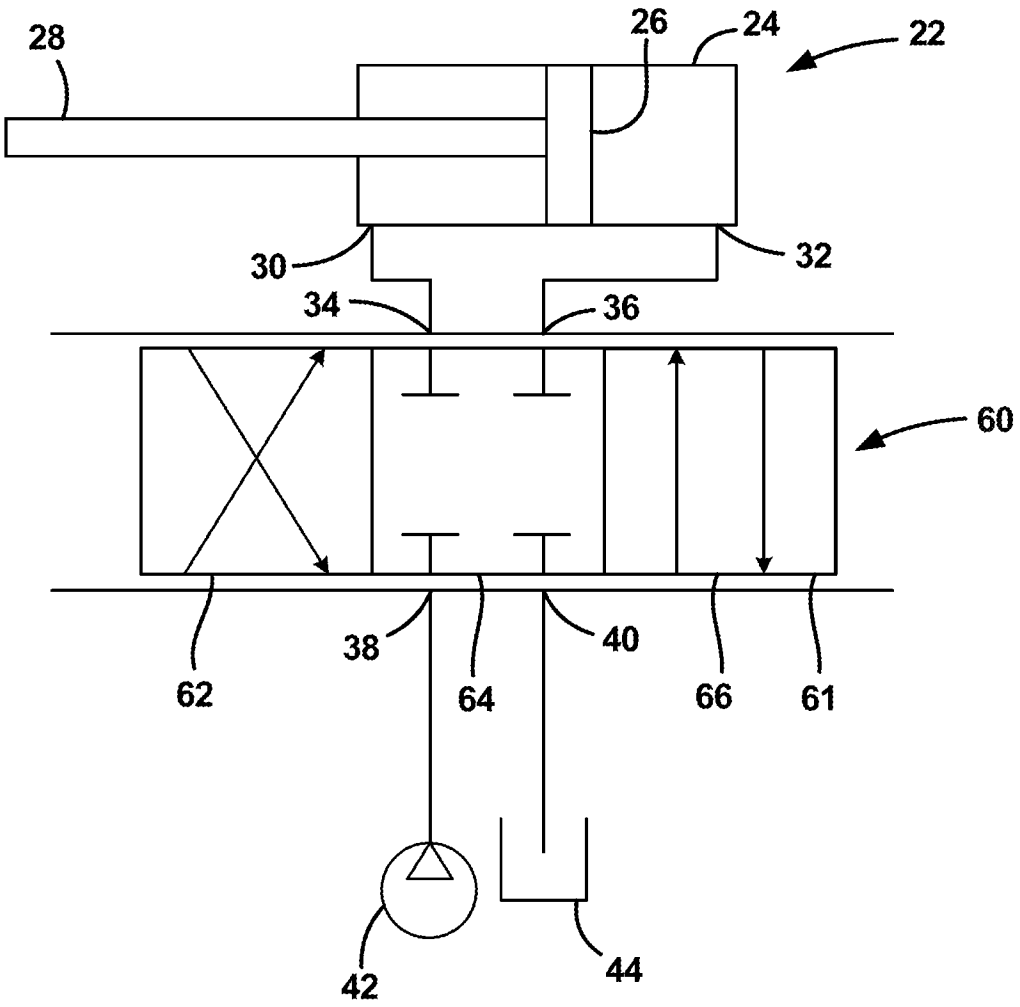
FIG. 2 (PRIOR ART)
FIG. 2 illustrates the hydraulic system of FIG. 1 modified to include a closed-center valve device.
Figure 3:
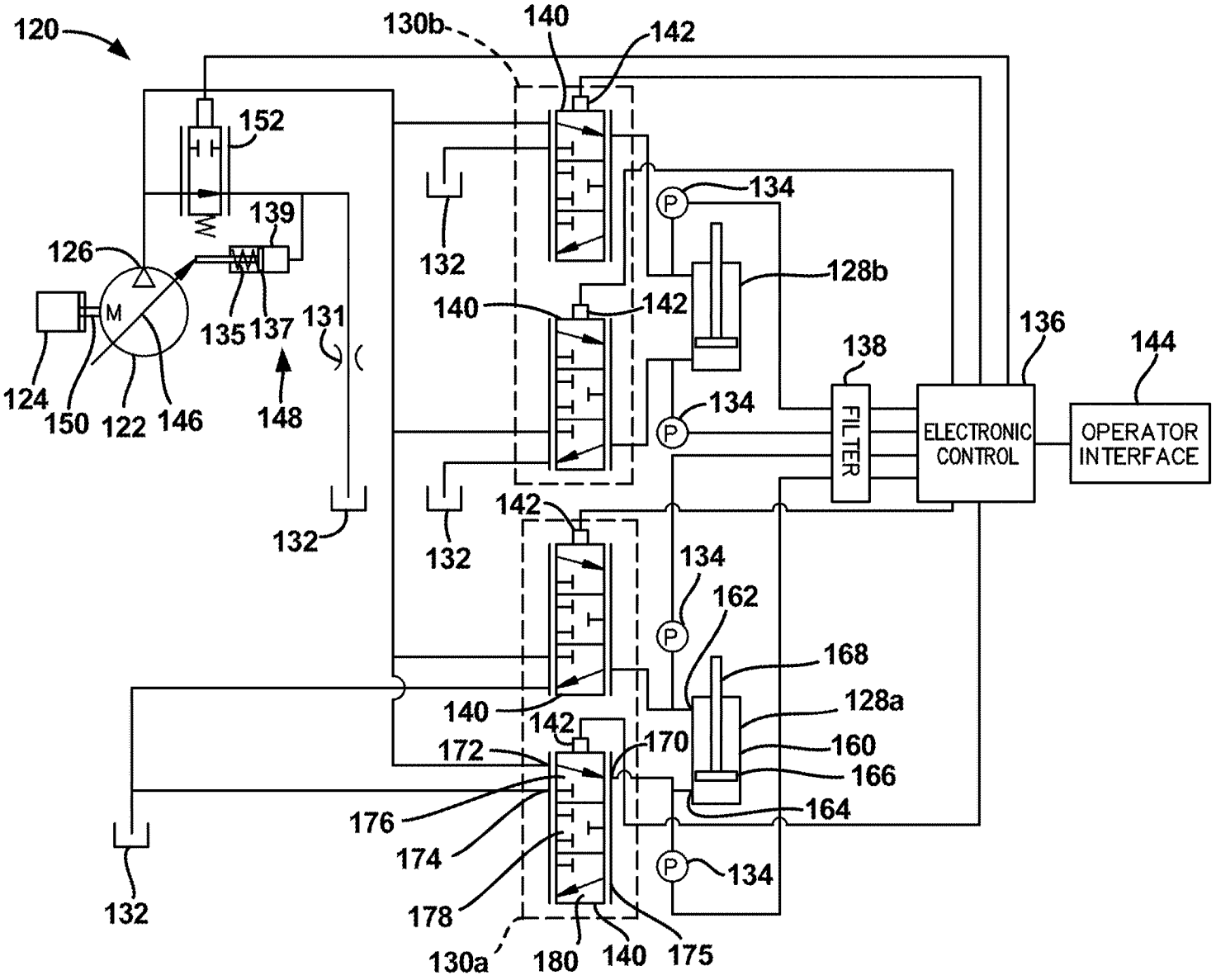
FIG. 3 illustrates a load-dependent flow control system in accordance with the principles of the present disclosure.

FIG. 3 illustrates a load-dependent flow control system 120 in accordance with the principles of the present disclosure. The load-dependent flow control system 120 includes a hydraulic pump 122 powered by a driver 124. The hydraulic pump 122 has a high pressure side 126 at which pressurized hydraulic fluid is outputted. The pressurized hydraulic fluid is used to power a plurality of actuators 128*a*, 128*b*. Closed-center valve devices 130*a*, 130*b* are used to control hydraulic fluid flow from the hydraulic pump 122 to the actuators 128*a*, 128*b*, and to control hydraulic fluid flow from the actuators 128*a*, 128*b* to a tank 132 (e.g., a reservoir). The load-dependent flow control system 120 also includes pressure sensors 134 for sensing (e.g., measuring) load pressures corresponding to the actuators 128*a*, 128*b*. The pressure sensors 134 interface with an electronic controller 136. One or more optional filters 138 can be used to filter noise from the pressure data sensed by the sensors 134. Each of the closed-center valve devices 130*a*, 130*b* includes two valve spools 140 and electro-actuators 142 for moving the valve spools 140. The electronic controller 136 interfaces with the electro-actuators 142 to control the electro-actuators. By controlling the electro-actuators 142, the electronic controller 136 can control the positions of the valve spools 140. The electronic controller 136 also interfaces with an operator interface 144 for allowing an operator to generate operator flow commands that are sent to the electronic controller 136. Based on the pressure readings provided by the sensors 134, the electronic controller 136 can modify the operator flow commands to convert the operator flow commands into pressure-based flow commands used to control the positions of the valve spools 140. The pressure-based flow commands can be dependent upon and variable with the pressures sensed by the pressure sensors 134. The sensed pressures are indicative of the loads being handled by the actuators 128*a*, 128*b*.

In certain examples, the hydraulic pump 122 can include a variable displacement pump. The displacement of the hydraulic pump 122 can be controlled by the position of a displacement controller such as a swash plate 146. The position of the swash plate 146 can be controlled by a hydraulic actuation arrangement 148. The hydraulic actuation arrangement 148 can be of the type used for load sense control and can include a hydraulic cylinder. The driver 124 can be coupled to the hydraulic pump 122 by a mechanical coupling such as a drive shaft 150. In certain examples, the driver 124 can include a power source such as an electric motor, an internal combustion engine (e.g., a diesel or spark ignition engine), a fuel cell or other power source.

It is preferred for the load dependent flow control system 120 to incorporate load-sense control technology. Load-sense control technology relates to an arrangement that ensures the output of the hydraulic pump 122 has a pressure that exceeds a maximum work pressure in the system 120 by a predetermined amount (e.g., 10 bars). In essence, in a load sense system, the system is configured such that the pump adjusts flow and pressure to match the load requirements of the system. In the depicted example, the sensed pressures provided by the pressure sensors 134 are used by the electronic controller 136 to identify the maximum operating pressure in the overall system 120. Based on the maximum operating pressure in the overall system, the electronic controller 136 controls operation of the hydraulic actuation arrangement 148 to ensure the output pressure of the hydraulic pump 122 exceeds the maximum system pressure by the predetermined amount. As indicated above, the hydraulic actuation arrangement 148 controls the position of the swash plate 146 and therefore controls the displacement of the hydraulic pump 122. In the depicted example, based on the maximum operating pressure sensed by the pressure sensors 134, the electronic controller 136 controls a position of an electronically controlled valve 152. The electronically controlled valve 152 taps into the output of the hydraulic pump 122 and uses this tapped pressure and flow to control the hydraulic actuation arrangement 148. By controlling operation of the electronically controlled valve 152, the electronic controller 136 can control the hydraulic pressure provided to the hydraulic actuation arrangement 148 and therefore control the position of the swash plate 146 to ensure the hydraulic pump 120 outputs sufficient pressure to exceed the maximum operating pressure in the system.

It will be appreciated that the load sense system of FIG. 3 is a hybrid system that uses a combination of electronic components and hydraulic components. The hydraulic actuation arrangement 148 can include a hydraulic cylinder 139 that is hydraulically actuated to control a position of the swash plate 146. When the closed-center valves are all closed, the pump 122 is fully de-stroked by the electronic controller 136 to a stand-by state in which only enough flow to account for system leakage is output by the pump 122. The electronic controller 136 can de-stroke the pump 122 by opening the valve 152 causing the hydraulic cylinder 139 of the actuation arrangement 148 to be pressurized such that a piston 137 of the hydraulic cylinder 139 moves (e.g., extends) against the pressure of a spring 135 to move the swash plate 146 to a de-stroked position. When one of the closed-center valve devices is opened, the electronic controller 136 detects the increase in pressure at the actuator corresponding to the open closed-center valve device and causes the pump 122 to be fully stroked to a maximum flow output until the flow and pressure output by the pump 122 matches the load. The electronic controller 136 can stroke the pump 122 by closing the valve 152. When the valve 152 is closed, hydraulic fluid in the hydraulic cylinder 139 drains to tank 132 through an orifice 131 thereby reducing the hydraulic pressure in the cylinder 139 to a level where the piston 137 and the swash plate 146 move via the spring force of the spring 135 to the stroked position. Once the output of the pump matches the load, the pump can be de-stroked (e.g., by metering flow through the valve 152) to an operating state where the flow and pressure level match the sensed load. By selectively increasing and decreasing the output of the pump by metering flow through the valve 152, a balanced operating state is maintained in which the flow and pressure level output by the pump matches the sensed load. When multiple loads are detected in the system, the pump is set to accommodate the highest load. The system also has a maximum pressure setting. If the output pressure at the pump reaches the maximum pressure setting, the electronic controller fully de-strokes the pump 120 and the system is maintained at the maximum pressure until the load clears. Once the load clears, the system resumes normal operation.

Figure 10:
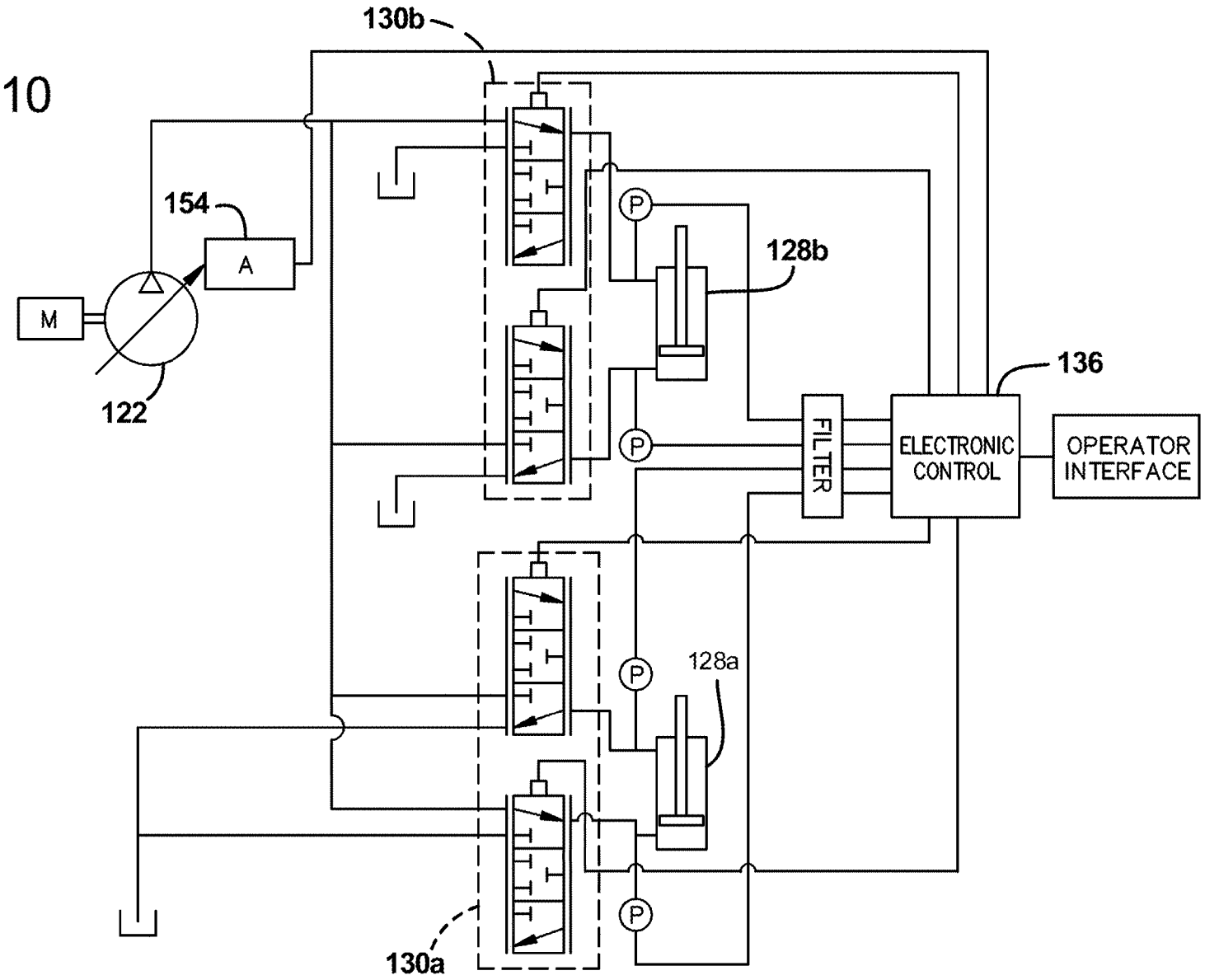
FIG. 10 illustrates another load-dependent flow control system in accordance with the principles of the present disclosure, the load-dependent flow control system of FIG. 10 having a pure electronic load-sense system.

FIG. 10 depicts a pure electronic load sense system where the electronic controller 136 interfaces electronically with an electronic actuator 154 that controls position of the swash plate 146. The system of FIG. 10 functions in the same manner as the system of FIG. 3, but does not use hydraulics. The controller 136 uses the data from the pressure sensors to electronically control the pressure and flow output of the pump. The electronic actuator 154 can include an actuator such as a solenoid or voice-coil actuator.

Figure 11A:
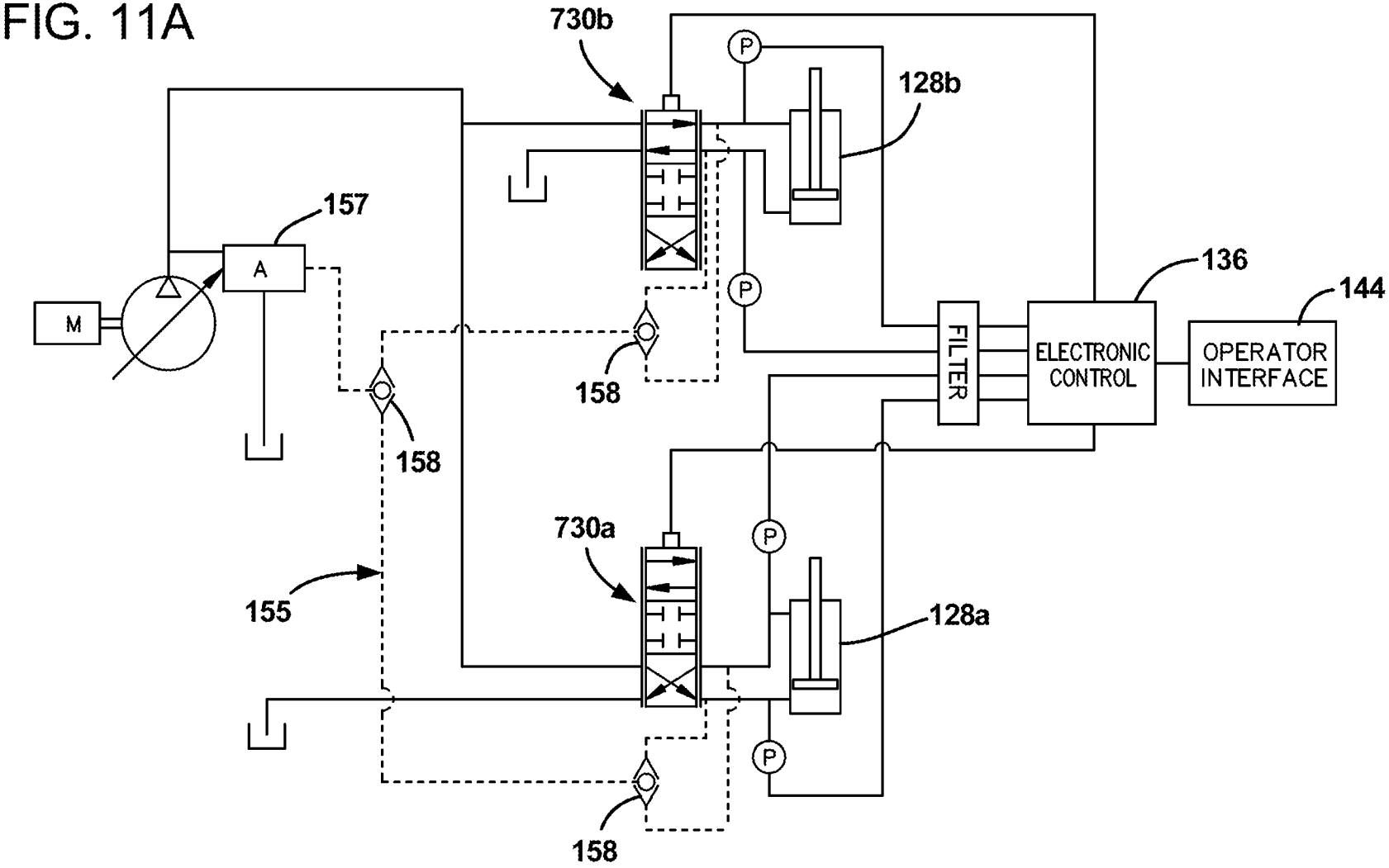
FIG. 11A illustrates another load-dependent flow control system in accordance with the principles of the present disclosure, the load-dependent flow control system of FIG. 11A including valve devices that do not provide independent metering for each of the ports of the actuators and including an all hydraulic load-sense system.
Figure 11B:
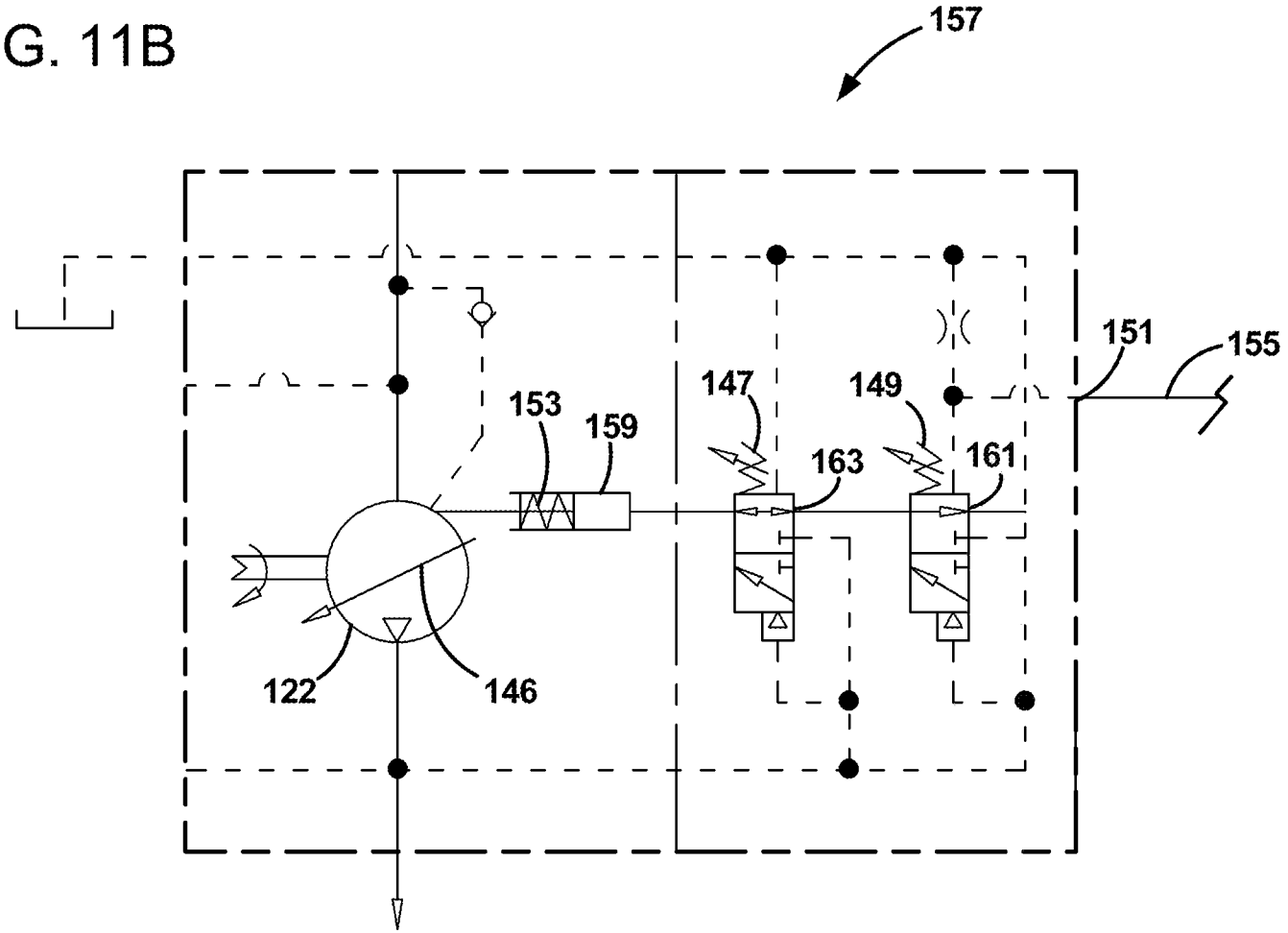
FIG. 11B illustrates a load sense pump control arrangement for the system of FIG. 11A.

FIG. 11A illustrates a more conventional load-sense system that only involves hydraulics. In this system, a load sense hydraulic circuit 155 is in fluid communication with the meter-out ports of the closed-center valve devices 730*a*, 730*b*. Through an arrangement of shuttle valves 158, the metering port having the highest operating pressure is placed in fluid communication with a hydraulic actuation arrangement 157. In one example, shown at FIG. 11B, the hydraulic actuation arrangement 157 can include a hydraulic cylinder 159 that controls the position of the pump swash plate. A load sense valve 161 is in fluid communication with the load sense hydraulic circuit 155 via a port 151. The hydraulic actuation arrangement 157 also includes a pressure limit valve 163. When the closed-center valve devices are closed, pressure from the pump output acts on the load sense valve 161 and overcomes a spring 149 (e.g., a 200 pound-per-square inch (psi) spring) of the load sense valve to move the load sense valve 161 to a position where the hydraulic cylinder 159 is disconnected from tank and is pressurized by the pump pressure. This causes the pump to be fully de-stroked. For example, the pressure in the hydraulic cylinder 159 moves the piston of the hydraulic cylinder 159 against the load of a spring 153 to move the swash plate to the de-stroked position. When one of the closed-center valve devices is opened, the load sense circuit 155 is pressurized and acts on the load sense valve 161 in concert with the spring 149 to move the valve against the pump pressure to a position where the hydraulic cylinder 159 is placed in fluid communication with tank. This causes the pressure in the hydraulic cylinder 159 to drop to a level where the piston of the hydraulic cylinder 159 is moved by the spring 153 to a position where the swash plate is in a fully stroked position. In continued operation, the pump pressure and the opposing pressure of the load-sense circuit 155 continue to act on the load sense valve 161 such that the valve 161 meters flow to the hydraulic cylinder 159 to provide a balanced state in which the output of the pump matches the load. The pressure limit valve 163 is acted on by the pump output pressure. When the pump pressure reaches a pressure limit, the pump output pressure overcomes a spring 147 (e.g., a 3000 psi spring) of the pressure limit valve 163 to place the hydraulic cylinder 159 in fluid communication with pump pressure causing the pump to be fully de-stroked until the pump pressure reduces.

Figure 4:
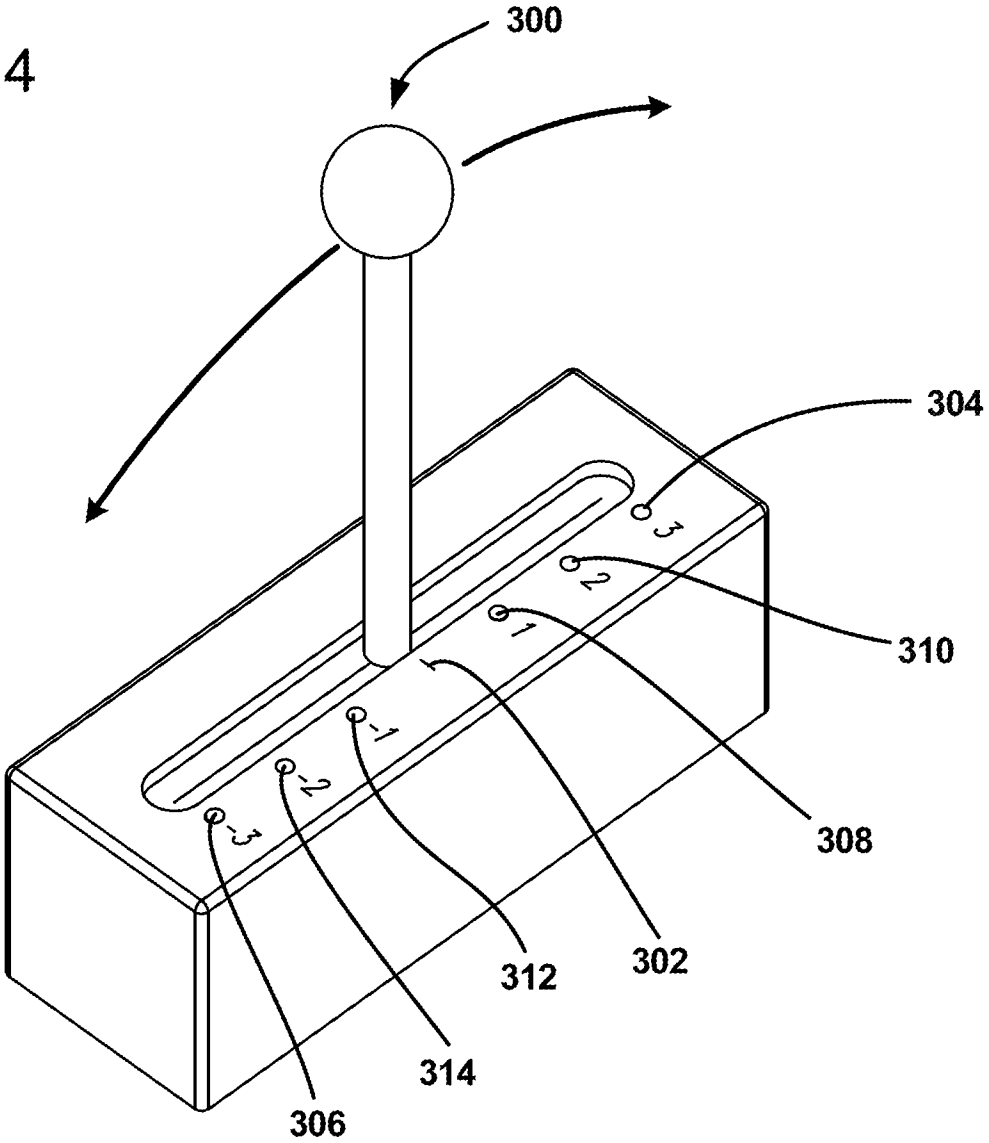
FIG. 4 depicts an example operator control interface.

The operator interface 144 is configured for allowing an operator to input an operator flow command to the electronic controller 136. In certain examples, the operator interface can include one or more input structures such as joysticks, toggles, dials, levers, touch screens, buttons, switches, rockers, slide bars or other control elements that can be manipulated by the operator for allowing the operator to control movement of the actuators 128*a*, 128*b*. Separate input structures can be provided at the operator interface 144 for each of the actuators 128*a*, 128*b* (e.g., separate input structures can be provided for controlling each of the closed-center valve devices 130*a*, 130*b*). It will be appreciated that the position of the manipulated control element can correspond to the magnitude of the operator flow command generated by the operator interface. For example, in the case of a joystick 300 (see FIG. 4), if the operator wants the actuator to stop, the joystick may be positioned at a neutral, central position 302. If the operator wants the actuator to extend at full speed, the joystick 300 may be moved to a full right position 304. If the operator wants the actuator to retract at full speed, the joystick 300 may be moved to a full left position 306. Between the center position and the full left position or the full right position are intermediate positions (e.g., see example intermediate positions 308, 310, 312, 314). The magnitude of the operator flow command signal may vary proportionately with the position of the joystick. Thus, in certain examples, the magnitude of the operator flow command will vary proportionately with a position of a component of the operator interface.

In certain examples, the filter 138 can be used to filter noise from the pressure data generated by the pressure sensors 134. In this way, relatively small variations in the sensed pressure can be filtered out to provide for more smooth control of the hydraulic actuators 128*a*, 128*b*. Filters can thus be used to shape the dynamics of flow rate modification.

The hydraulic actuators 128*a*, 128*b* are depicted as hydraulic cylinders. In other examples, the hydraulic actuators can include hydraulic motors or other types of actuators. Each of the hydraulic actuators 128*a*, 128*b* includes a cylinder body 160 defining first and second cylinder ports 162, 164. Each of the actuators 128*a*, 128*b* also includes a piston arrangement including a piston head 166 and a piston rod 168. It will be appreciated that the cylinder body 160 and/or the piston rod 168 is adapted for connection to a load. The actuators can provide various functions such as boom swinging, boom lifting, bucket or blade manipulation, vehicle propulsion, boom pivoting, vehicle lifting, vehicle tilting, drill propulsion, drill rotation or other functions.

Each of the closed-center valve devices 130*a*, 130*b* includes two of the valve spools 140. Each of the valve spools 140 corresponds to one of the cylinder ports 162, 164 of the corresponding actuator 128*a*, 128*b*. Thus, the valve spools 140 each independently control flow to each of the cylinder ports 162, 164, since separate valve spools 140 are provided for each of the ports 162, 164.

With respect to each of the valve spools 140, the closed-center valve devices 130*a*, 130*b* include a first valve port 170 corresponding to one of the cylinder ports 162, 164, a second valve port 172 hydraulically connected to the high pressure side of the hydraulic pump 122 and a third valve port 174 coupled in fluid communication with tank 132. It will be appreciated that the valve ports 170, 172, 174 can be defined within valve housings defining valve sleeves 175 of the closed-center valve devices 130*a*, 130*b*. The valve spools 140 are axially moveable within the valve sleeves 175 to change the positions of the valve spools 140 relative to the ports 170, 172, 174. Movement of the valve spools 140 can be implemented through operation of the electro-actuators 142. In certain examples, the electro-actuators 142 can include actuators such as solenoid actuators, voice coil actuators, combined hydraulic and electronic actuators or other type of actuators.

Each of the valve spools 140 includes a left section 176, a center section 178, and a right section 180. The center section 178 has a closed-center arrangement adapted to block fluid communication between the first valve port 170 and the second and third valve ports 172, 174 when the valve spool 140 is in a central position. With the valve spool 140 in the central position, the second and third valve ports 172, 174 are isolated from one another. The left and right sections 176, 180 have flow paths for controlling directional flow to the actuators. The valve spools 140 slide within the sleeves 175 and can function as metering valves for controlling fluid flow rates based on the positions of the spools 140 within the sleeve 175. By controlling the degree of alignment between the flow paths of the valve sections 176, 180 and the valve ports 170, 172, 174, the orifice size through the valve can be controlled to control flow rates through the flow paths.

When one of the valve spools 140 is positioned such that flow path of the left section 176 of the valve spools 140 is in fluid communication with the valve ports 170 and 172, the valve port 170 is placed in fluid communication with the high pressure side of the hydraulic pump 122 and the port 174 is blocked. When one of the valve spools 140 is positioned such that flow path of the right section 180 of the valve spools 140 is in fluid communication with the valve ports 170 and 174, the valve port 170 is placed in fluid communication with tank and the port 172 is blocked.

The electro-actuators 142 control the positions of the valve spools 140. It will be appreciated that the electro-actuators 142 can move the valve spools 140 to change the direction of movement of the pistons (i.e., the valves can be directional valves). For example, as shown at FIG. 3, the valve spools 140 of the closed-center valve device 130*a* are in a position where the piston head 166 of the actuator 128*a* is driven in an upward (or leftward) direction. In this configuration, the upper spool 140 of the device 130*a* is positioned with the right section 180 at the valve ports 170, 172, 174 and the lower spool 140 of the device 130*a* is positioned with the left section 176 at the valve ports 170, 172, and 174. By moving the valve spools 140 with the electro-actuators 142, the direction of flow through the actuator 128 can be reversed to reverse the direction of movement of the piston head 166. The closed-center valve device 130*b* is shown with the valve spools reversed to cause the piston head 166 of the actuator 128*b* to be driven in a downward (or rightward) direction. In this configuration, the upper spool 140 of the device 130*b* is positioned with the left section 176 at the valve ports 170, 172, 174 and the lower spool 140 of the device 130*b* is positioned with the right section 180 at the valve ports 170, 172, and 174. In addition to moving the valve spools 140 to alter the direction of flow through the actuators 128*a*, 128*b*, the electro-actuators 142 can also move the valve spools 140 to meter flow through the first valve ports 170 to control the flow rate provided to the actuators 128*a*, 128*b* and to thus control the speed of the actuators 128*a*, 128*b*. In other words, the electro-actuators 142 can be used to control the orifice size provided at the first valve ports 170 to control the flow rates provided to and from the actuators 128*a*, 128*b*. By enlarging the orifice size, the flow rate is increased. By reducing the orifice size, the flow rate is decreased. Thus, the closed-center valve devices preferably function as directional valves and metering valves.

It will be appreciated that the flow rates through the closed-center valve devices are dependent upon the spool positions and the orifice sizes corresponding to the spool positions. In certain examples, the system can be configured such that the closed-center valve devices are pressure compensated so that the pressure drops across the valve devices remain constant regardless of changes in the load pressure. With pressure compensated valves of this type, a given orifice size will always provide a given flow since the pressure drop across the orifice is constant regardless of load pressure. In other examples, the system can sense the pressure drop across a given closed-center valve device and can adjust the orifice size based on pressure drop to achieve a controller commanded flow rate established by the electronic controller 136. It will be appreciated that the controller commanded flow rate established by the electronic controller 136 can be dependent upon a magnitude of an operator flow command from the operator interface 144. In certain examples, the electronic controller 136 will be capable of commanding different flow rates for a given operator flow command dependent on a measured pressure at the actuator controlled by the closed-center valve device at issue. In cases where actuator pressure is taken into account for determining the controller commanded flow rate through the valve, the electronic controller 136 can modify the operator flow command based on sensed pressure at the actuator to generate the controller commanded flow rate (e.g., the controller commanded flow rate is dependent on 2 variables, namely, the sensed load pressure and the magnitude of the operator flow command). In cases where actuator pressure is not taken into account for determining the controller commanded flow rate through the valve, the controller commanded flow rate is only based on the operator flow command (e.g., the operator flow command is the only variable upon which the controller commanded flow rate depends).

It will be appreciated that the electronic controller 136 can include software, firmware and/or hardware. Additionally, the electronic controller 136 can include memory. In certain examples, the electronic controller can interface with memory (e.g., random access memory, read-only memory, or other data storage means) that stores algorithms, look-up tables, look-up graphs, look-up charts, control models, empirical data, control maps or other information that can be accessed for use in controlling operation of the flow control system. The electronic controller can include one or more microprocessors or other data processing devices. A Controller Area Network (CAN bus) can be used to provide an architecture that allows the processors (e.g., micro-processors), sensors, actuation devices, and other devices to communicate with one another.

Figure 5:
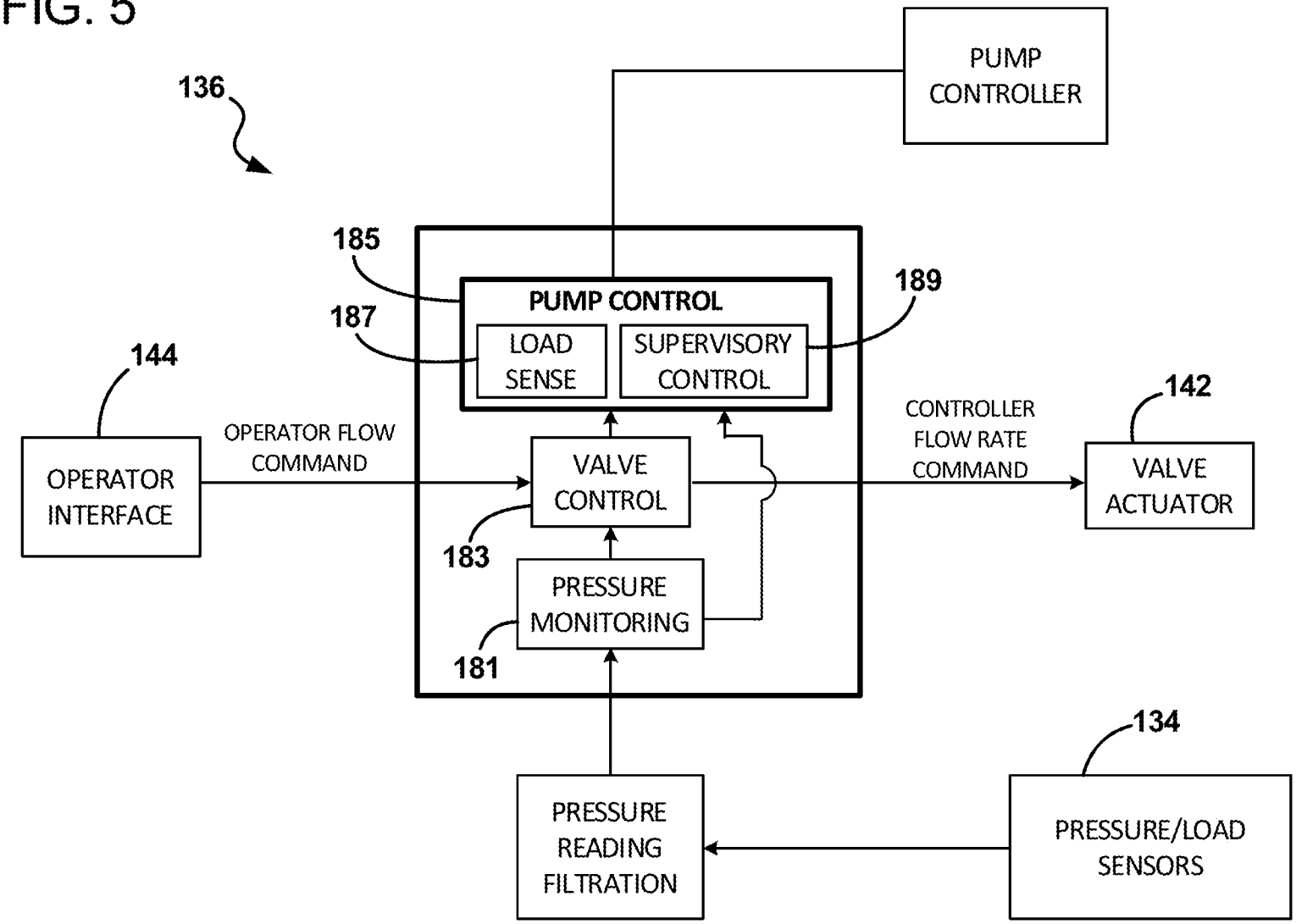
FIG. 5 schematically illustrates aspects of an electronic controller for use in the load-dependent flow control system of FIG. 3.

Referring to FIG. 5, the electronic controller 136 includes digital or analog processing capability for providing pressure monitoring functionality 181, valve control 183 and pump control 185. Suitable electronic processing capability and data storage capability (e.g., memory) can be used or dedicated for each function. A combined electronic processing unit can be used to implement the various functions, or multiple separate processing units/processors can work together and can be used or dedicated for the different functions. The electronic controller 136 interfaces with the pressure sensors 134 to provide the pressure monitoring functionality 181. For example, the electronic controller 136 receives sensed pressure data from the pressure sensors 134. The sensed pressure data corresponds to the sensed pressures at the ports 162, 164 of the actuators 128*a*, 128*b*. The sensed pressures depend upon and are indicative of load on the actuators 128*a*, 128*b*. The electronic controller 136 uses the sensed pressure data generated by the pressure sensors 134 for both pump control 185 and valve control 183.

Figure 6:
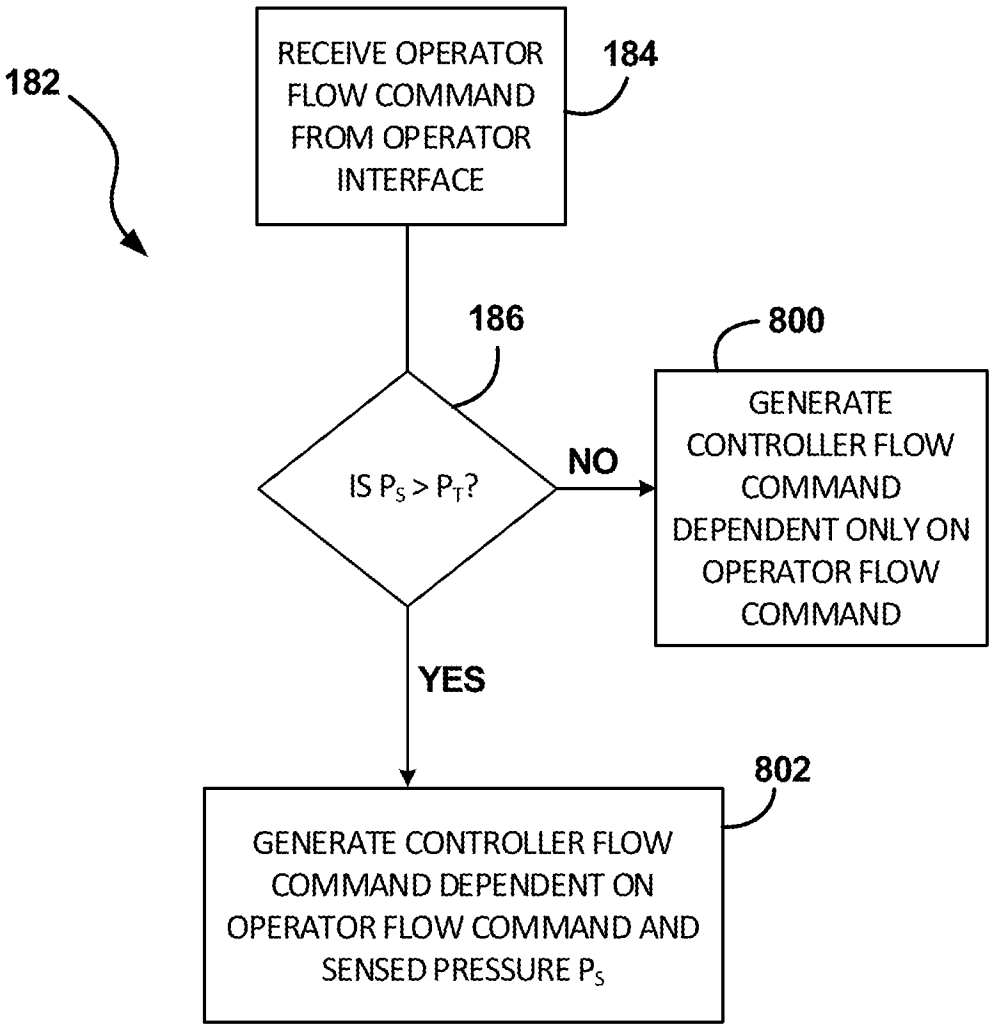
FIG. 6 illustrates control logic that can be used by the electronic controller of FIG. 5 to determine whether to apply a flow command modification function/protocol to an operator flow command.

The valve control 183 of the electronic controller 136 is adapted to receive operator flow commands from an input structure of the operator interface 144 and to process the operator flow commands according to flow command logic 182 (see FIG. 6). As shown at FIGS. 5-6, the electronic controller 136 initially receives an operator flow command from the operator interface 144 (see box 184). Next, at box 186, the electronic controller 136 compares the sensed load pressure $P_s$ for the actuator 128*a*, 128*b* to which the operator flow command corresponds with a threshold pressure $P_T$. In one non-limiting example, the threshold pressure $P_T$ is at least 20 Bars, or at least 30 Bars. If the sensed pressure $P_s$ is less than the threshold pressure $P_T$, then the flow command logic dictates that the controller flow command generated and output by the electronic controller 136 is based only on the magnitude/value of the operator flow command (see box 800). Hence, the flow commanded by the controller 136 at the valve of the actuator is not pressure dependent, but instead is only dependent on a single variable, namely, the value of the operator flow command. The controller flow command, based only on the value of the operator flow command, is sent to the electro-actuators 142 of the closed-center valve device 130*a* or 130*b* being controlled by given input structure of the operator interface 144 to control the flow to the corresponding actuator 128*a* or 128*b*. If the sensed pressure $P_s$ is greater than the threshold pressure $P_T$, then the flow command logic dictates that the controller generated flow command is dependent upon two separate variables which include: sensed pressure $P_s$ and the value of the operator flow command (see box 802). For example, the flow that would have been commanded based on the value of the operator flow command if the sensed pressure $P_s$ was less than the threshold pressure $P_T$ (i.e., a base flow) is reduced a particular amount based on the sensed pressure $P_s$. The amount the base flow is reduced can be dependent upon the sensed pressure $P_s$ and can be derived/calculated by a function that includes the sensed pressure $P_s$ as a variable. The pressure-based controller flow command is sent to the electro-actuators 142 of the closed-center valve device 130*a* or 130*b* being controlled by given input structure of the operator interface 144 to control the flow to the corresponding actuator 128*a* or 128*b*. By using the sensed pressure $P_s$ as a factor in determining the commanded flow rate through the closed-center valve being controlled, the system can provide a load dependent feel to the operator at load pressures above the threshold pressure $P_T$.

In other examples, the system may be designed so that the controller flow command always takes into consideration both the operator flow command and the sensed load pressure of the actuator being controlled. In this situation, the threshold pressure $P_T$ is essentially set to zero.

It will be appreciated that a function (e.g., formula, equation, relationship, etc.) can be used to generate pressure-based flow control command based on the value of the operator flow command and the sensed pressure $P_s$. The controller can apply the function directly to determine the controller flow commands, or can use data maps or like tools based on the function to determine the controller flow commands. In one example, the function can include a linear function that includes pressure as a variable and that reduces the flow established only by the operator flow command by an amount dependent on sensed pressure $P_s$. In other examples, the functions can include curved functions (e.g., exponential functions) based on pressure, more complex polynomial functions (e.g., quadratic functions), and/or specialized functions (e.g., a function defining a virtual center orifice).

The following formula (1) is an example linear pressure-based flow modification function:

$$Q_2=Q_1-f(P_s),\ \text{where}\ f(P_s)=aP_s \tag{1}$$

In formula (1), $Q_2$ is the flow dictated by the electronic controller flow command, $Q_1$ is the flow that would have been dictated by the controller based only on the value of the operator flow command (e.g., a base flow), a is a constant, and $P_s$ is the sensed load pressure.

The following formula (2) is an example exponential pressure-based flow modification function:

$$Q_2=Q_1-f(P_s),\ \text{where}\ f(P_s)=aP_s^n \tag{2}$$

In formula (2), $Q_2$ is the flow dictated by the electronic controller flow command, $Q_1$ is the flow that would have been dictated by the controller based only on the value of the operator flow command (e.g., a base flow), a is a constant, $P_s$ is the sensed load pressure, and n is a whole number greater than 1.

The following formula (3) is an example of a more complicated polynomial pressure-based flow modification function such as a quadratic function:

$$Q_2=Q_1-f(P_s),\ \text{where}\ f(P_s)=a_1P_s^1+\ldots+a_nP^n \tag{3}$$

In formula (3), $Q_2$ is the flow dictated by the electronic controller flow command, $Q_1$ is the flow that would have been dictated by the controller based only on the value of the operator flow command (e.g., a base flow), the $a_1 \ldots a_n$ values are different constants, $P_s$ is the sensed load pressure, and n is a whole number greater than 1.

The following formula (4) is an example of a modification function that defines a virtual center orifice:

$$Q_2 = Q_1 - \frac{\sqrt{Ps}}{\sqrt{\rho}} C_d A(Q_1) \tag{4}$$

In formula (4), $Q_2$ is the flow dictated by the electronic controller flow command, $Q_1$ is the flow that would have been dictated by the controller based only on the value of the operator flow command (e.g., a base flow), ρ is a constant determined by the density of the hydraulic fluid of the system, $P_s$ is the sensed load pressure, and $A(Q_1)$ is a virtual center orifice area profile for the valve.

Figure 7:
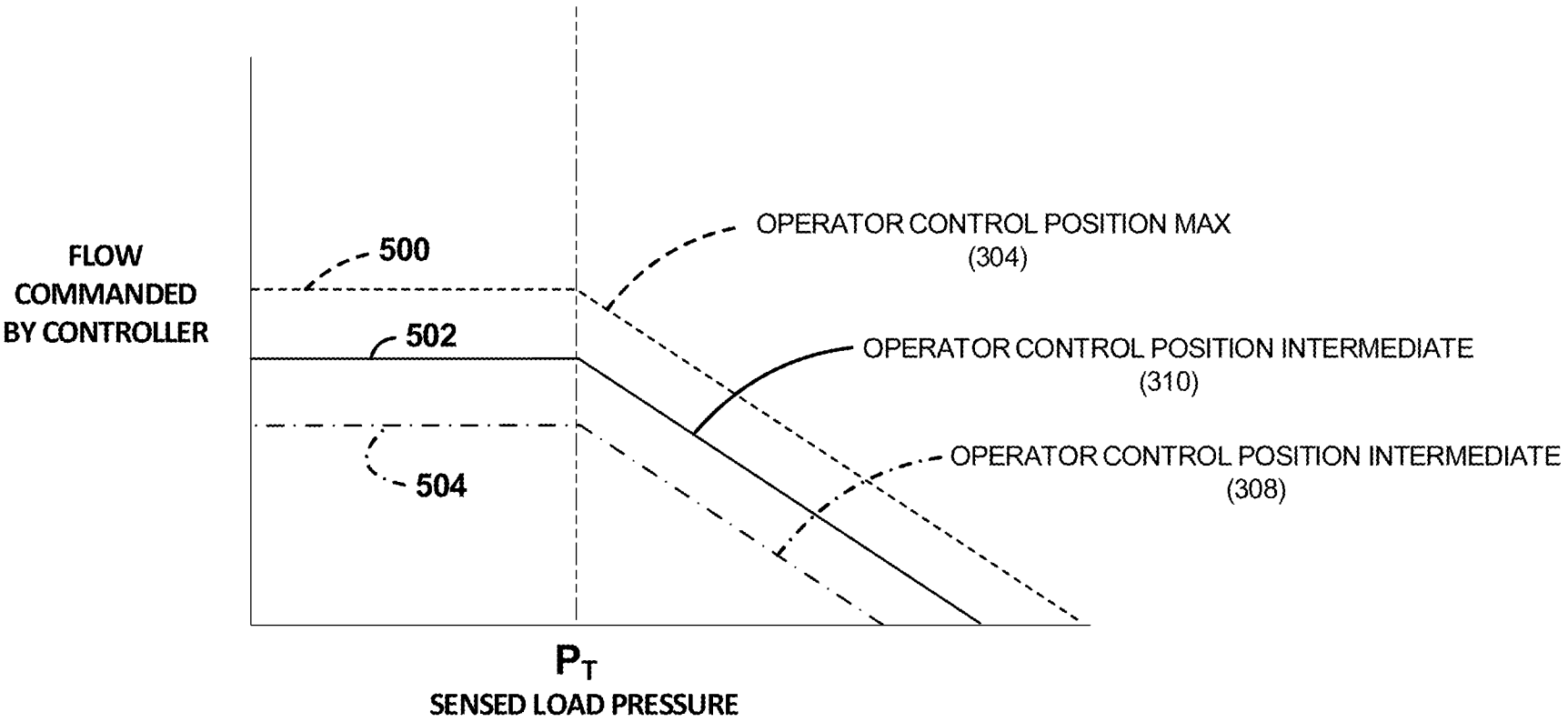
FIG. 7 is a graph plotting actuator flow verses load pressure for different example control positions of an operator control.

FIG. 7 is a graph showing data corresponding to a linear function used by the electronic controller to generate controller flow commands. The graph includes three plots 500, 502, 504 showing flow rates commanded by the electronic controller 136 verses sensed load pressure. The plot 500 shows controller commanded flow verses sensed pressure for an operator flow command having a first value. In one example, the operator flow command having the first value can be generated when an operator control such as the joystick 300 is in the maximum position 304 (see FIG. 4). The plot 502 shows controller commanded flow verses sensed pressure for an operator flow command having a second value less than the first value. In one example, the operator flow command having the second value can be generated when an operator control such as the joystick 300 is in the intermediate position 310 (see FIG. 4). The plot 504 shows controller commanded flow verses sensed pressure for an operator flow command having a third value less than the second value. In one example, the operator flow command having the third value can be generated when and operator control such as the joystick 300 is in the intermediate position 308 (see FIG. 4). As shown by FIG. 7, when the sensed pressure is less than the threshold pressure, the flows commanded by the controller 136 are not pressure dependent. For sensed pressures less than the threshold pressure, the plots 500, 502, 504 are horizontal indicating that the flows commanded by the electronic controller are constant for each of the first, second and third operator flow command values across the range of pressures less than the threshold pressure. For sensed pressures greater than the threshold pressure, the plots 500, 502, 504 angle linearly downwardly as the sensed pressure increases indicating that the flows commanded by the electronic controller are progressively reduced for each of the first, second and third operator flow command values across the range of pressures greater than the threshold pressure as the sensed pressures increase.

Figure 8:
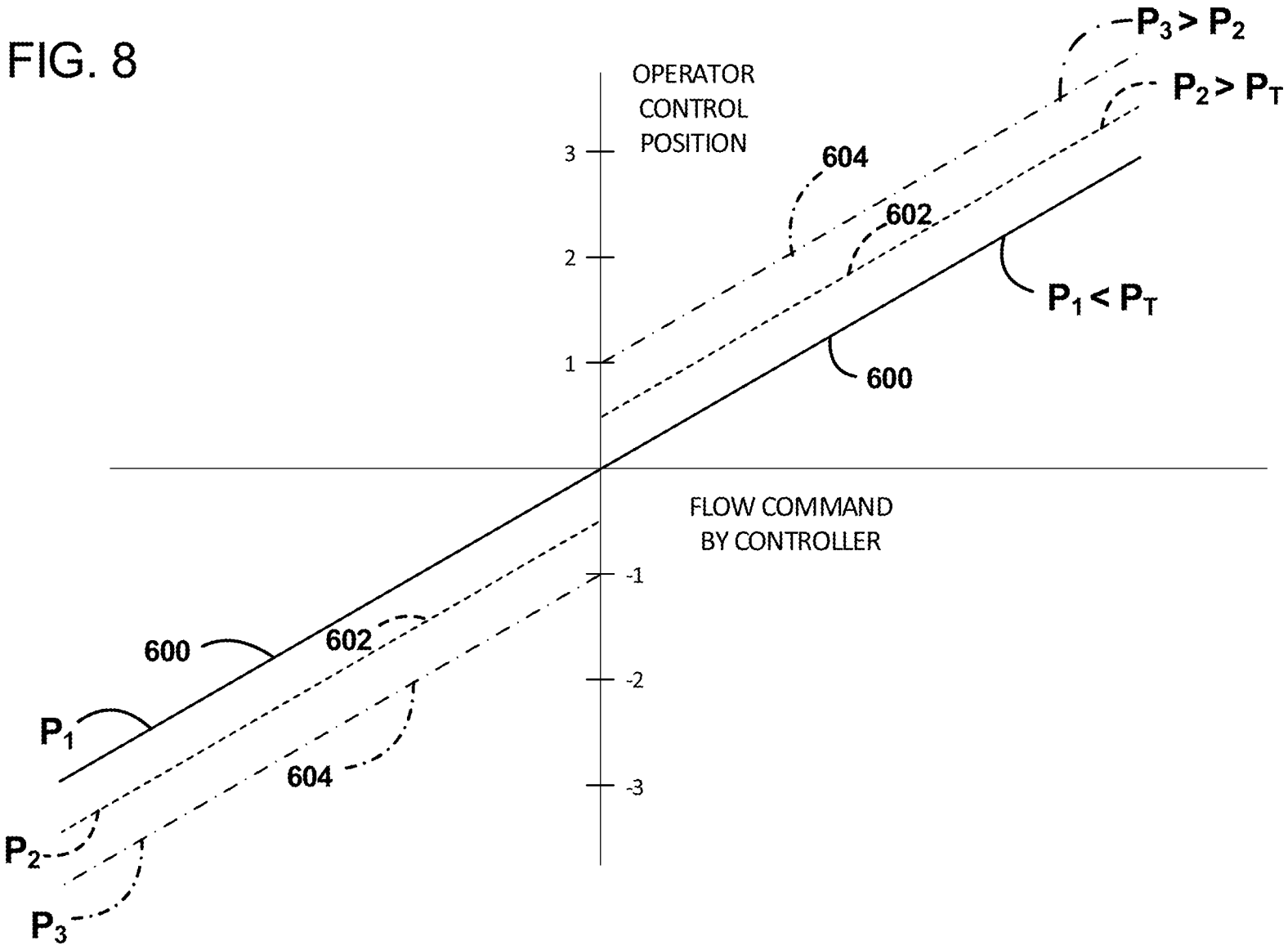
FIG. 8 is a graph plotting controller position verses actuator flow for different example load pressures.

FIG. 8 is another graph showing data corresponding to a linear function used by the electronic controller to generate controller flow commands. The graph includes three plots $P_1$, $P_2$ and $P_3$ showing flow rates commanded by the electronic controller 136 verses the position of the operator control that generates operator flow control commands. Plot $P_1$ is for a sensed pressure less than the threshold pressure and represents base line 600 for flow data. When the sensed pressure is less than the threshold pressure, the base line 600 establishes the flow commanded by the electronic controller for a given position of the operator control. Plot $P_2$ is for a sensed pressure greater than the threshold pressure and represents a controller flow command line 602 for the pressure $P_2$. When the sensed pressure is at $P_2$, the controller flow command line 602 establishes the flow commanded by the electronic controller for a given position of the operator control. It is noted that the flow commanded by the controller 136 at the pressure $P_2$ for a given operator flow command is less than the flow commanded by the controller 136 at the pressure $P_1$ for the same operator flow command. Plot $P_3$ is for a sensed pressure greater than the pressure $P_2$ and represents a controller flow command line 604 for the pressure $P_3$. When the sensed pressure is at $P_3$, the controller flow command line 604 establishes the flow commanded by the electronic controller for a given position of the operator control. It is noted that the flow commanded by the controller 136 at the pressure $P_3$ for a given operator flow command is less than the flow commanded by the controller 136 at the pressure $P_2$ for the same operator flow command.

Figure 9A:
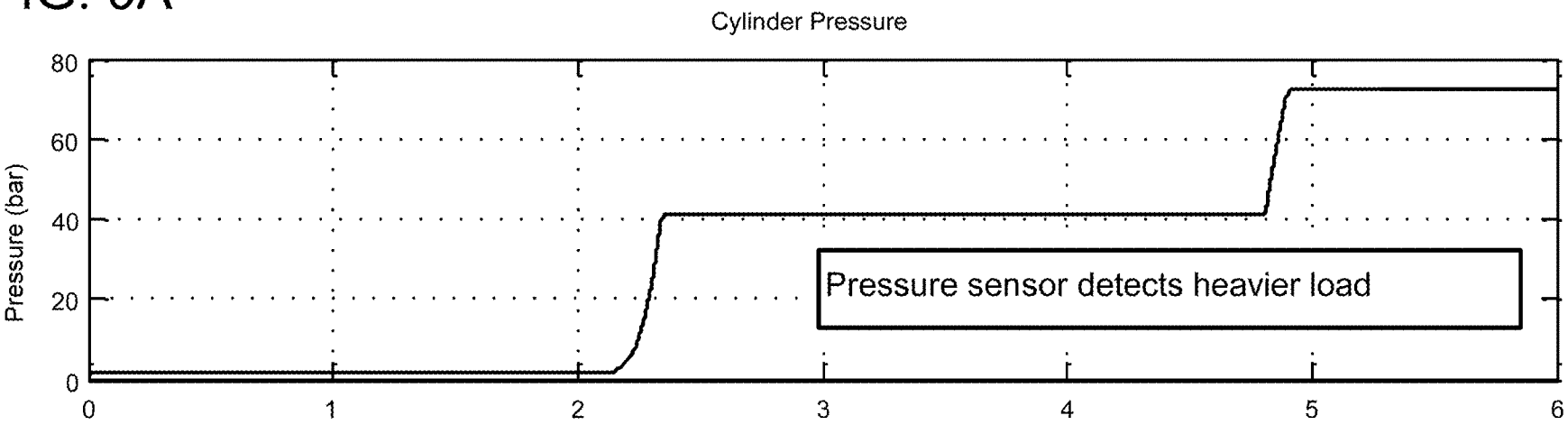
FIG. 9A is a graph plotting sensed pressure over time for one of the actuators of the load dependent flow control system of FIG. 3.

FIGS. 9A-9D are graphs which plot various operating characteristics of an actuator controlled by a control system having flow control logic of the type disclosed herein. In FIGS. 9A-9D, the value of the operator flow command remains constant over the time period involved (e.g., the operator maintains the controller of the operator interface in the same position over the time period). In one example, the actuator can be coupled to an excavator arm. FIG. 9A is a plot showing sensed load pressure versus time. Initially, from zero to about two seconds, the arm is lowered toward the ground. During this time period, the sensed pressure is less than the threshold pressure. Just after two seconds, the arm contacts the ground thereby causing the sensed load pressure to increase to a value over the threshold pressure. At just before five seconds, the excavator arm encounters harder soil and the sensed load pressure again increases.

Figure 9B:
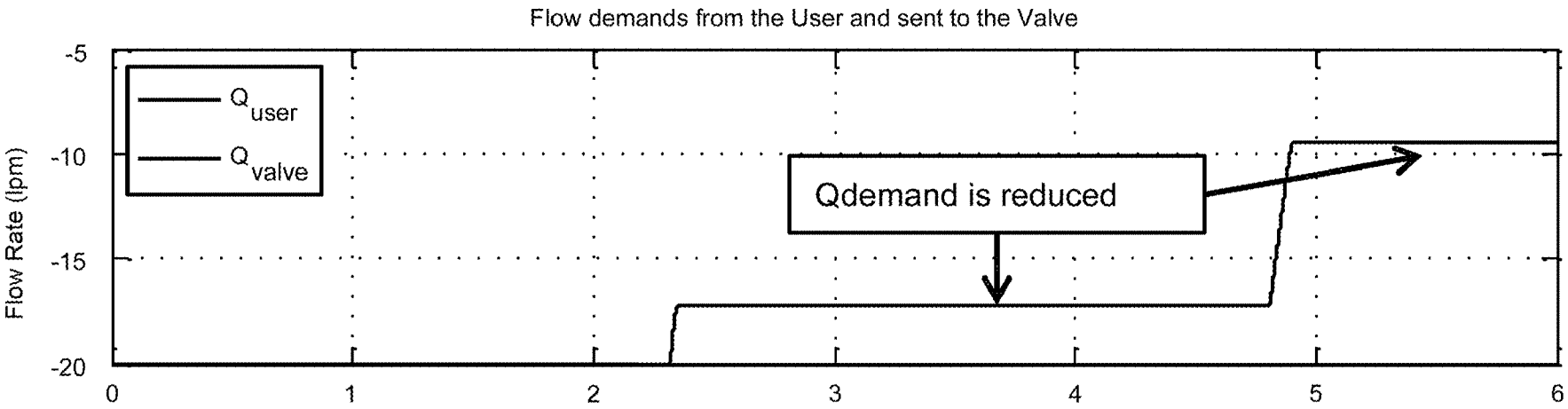
FIG. 9B is a graph plotting flow rate provided to the actuator of FIG. 9A over the same time period, with the flow rate being established through the use of a pressure-based flow command modifying strategy.

FIG. 9B shows the flow rate provided to the actuator over the same time period of FIG. 9A. As shown at FIG. 9B, when the load pressure increases above the threshold pressure just after the two second mark, the flow rate is reduced to reduce the speed of the actuator. Similarly, when the pressure increases just before the five second mark, the flow rate is again reduced in a manner proportional to the increase in the load pressure.

Figure 9C:
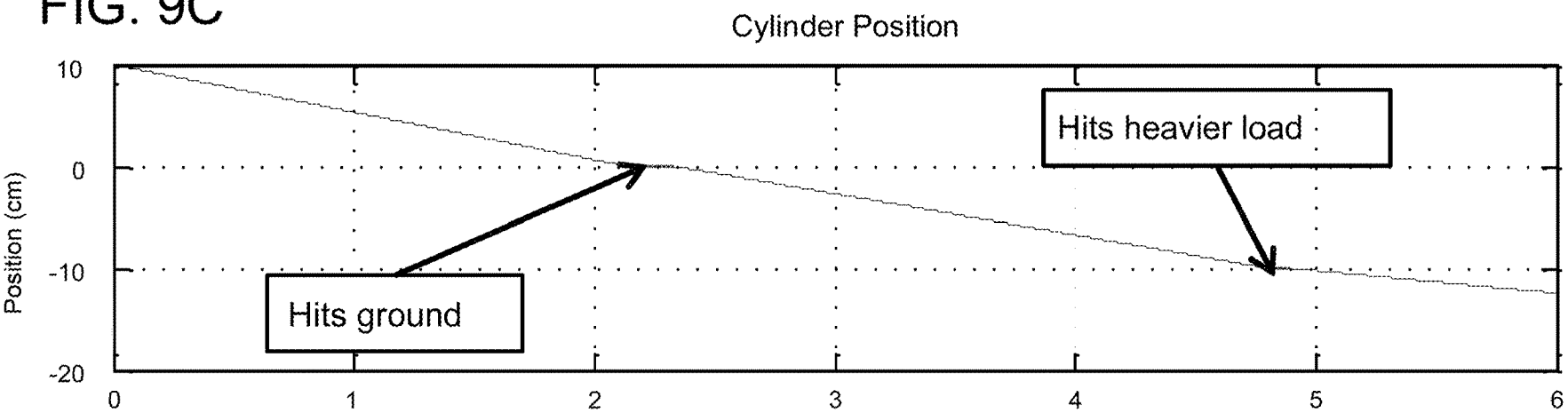
FIG. 9C is a graph plotting the cylinder position of the actuator of FIG. 9A over the same time period.

FIG. 9C shows the position of the excavation arm with respect to ground level over the same time period as the graphs of FIGS. 9A and 9B. Based on the slopes of the lines of FIG. 9C, the downward speed of the excavation arm is reduced slightly after the two second mark when the load pressure increases above the threshold pressure, and is further reduced just before the five second mark.

Figure 9D:
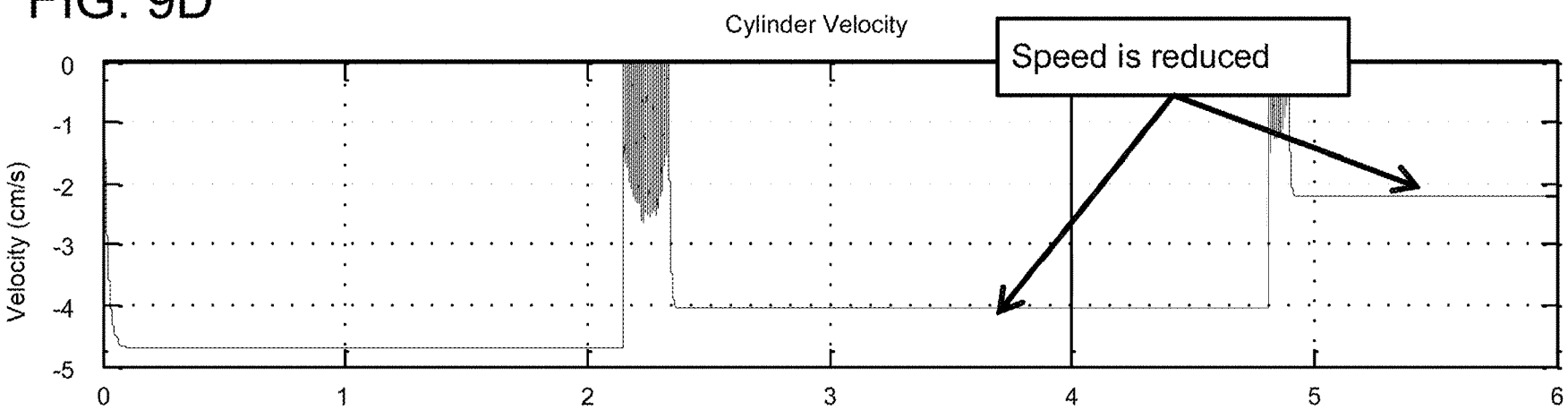
FIG. 9D is a graph plotting the velocity of the cylinder of the actuator of FIG. 9A over the same time period.

FIG. 9D illustrates the velocity of the cylinder over the same time period as FIGS. 9A-9D. Similar to FIG. 9C, FIG. 9D shows the velocity of the cylinder reducing slightly after the two second mark and then again reducing slightly before the five second mark in reaction to the change in cylinder pressure. It will be appreciated that the change in speed is a result of applying a linear function dependent upon pressure to the base line flow demand input by the operator from the operation interface.

The pump control 185 of the electronic controller 136 controls operation of the variable displacement pump 122. The pump control 185 can include load sense control logic 187 that uses pressure information from the pressure sensors to control the pump 12 such that the pump 122 adjusts flow and pressure to match the load requirements of the system. In certain examples, the pump control 185 can also include supervisory control logic 189 that can use the pressures sensed at the actuators to selectively limit the flow provided to one or more of the actuators. In certain examples, certain actuators can be prioritized over other actuators. By limiting the flow demand based on pressure, the power to a single service can be capped. A supervisory controller can communicate with all services and can limit the total power (or torque) of the system. By measuring the maximum pressure of the actuators in the system, the supervisory controller can limit the sum of the flow demands to all the valves.

The various examples described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A load dependent flow control system for directing hydraulic fluid to a hydraulic actuator having first and second ports, the load dependent flow control system comprising:

a closed-center valve device for controlling hydraulic fluid flow to the actuator, the closed-center valve device including a first closed-center valve for controlling flow through the first port and a second closed center valve for controlling flow through the second port, the first closed-center valve including a first valve spool and a first electro-actuator for adjusting a position of the first valve spool, the second closed-center valve including a second valve spool and a second electro-actuator for adjusting a position of the second valve spool;

a first pressure sensor for sensing hydraulic pressure at the first port and a second pressure sensor for sensing hydraulic pressure at the second port; and an electronic controller configured to receive an operator flow command from an operator interface, the operator flow command corresponding to a base flow rate through the closed-center valve device, the electronic controller interfacing with the first electro-actuator and the second electro-actuator and with the first and second pressure sensors, wherein at least when one of the sensed pressures is above a threshold pressure, the electronic controller uses the operator flow command and the at least one of the sensed pressures to generate a pressure-modified flow command that is sent to the closed-center valve device to control flow through the closed-center valve device, the pressure-modified flow command corresponding to a pressure-modified flow rate through the closed-center valve device, the pressure-modified flow rate being less than the base flow rate through the closed-center valve device;

wherein a magnitude of the pressure-modified flow rate commanded by the electronic controller for the operator flow command is inversely related to at least one of the sensed pressures.

2. The load dependent flow control system of claim 1, wherein when the sensed pressures are each less than or equal to the threshold pressure, and wherein the threshold pressure is at least 20 Bars, the electronic controller controls the closed-center valve device based on the operator flow command independent of the sensed pressures.

3. The load dependent flow control system of claim 1, wherein the electronic controller determines the pressure-modified flow rate based on a linear, exponential or quadratic function including the at least one of the sensed pressures as a variable.

4. The load dependent flow control system of claim 1, wherein when the sensed pressures are each less than or equal to the threshold pressure the electronic controller controls the closed-center valve device, based on the operator flow command independent of the sensed pressures.

5. The load dependent flow control system of claim 1, wherein the system is a load-sense system.

6. A load dependent flow control system, the load dependent flow control system comprising:

a variable displacement pump;

a first hydraulic actuator and a second hydraulic actuator to which the load dependent flow control system directs hydraulic fluid;

a first closed-center valve device for controlling hydraulic fluid flow to the first hydraulic actuator and including a first valve spool and a first electro-actuator that adjusts a position of the first valve spool to adjust a rate of the hydraulic fluid flow supplied to the first hydraulic actuator through the first closed-center valve device, and a second closed-center valve device for controlling hydraulic flow to the second hydraulic actuator and including a second valve spool and a second electro-actuator that adjusts a position of the second valve spool to adjust a rate of the hydraulic fluid flow supplied to the second hydraulic actuator through the second closed-center valve device;

pressure sensors for sensing pressures of the hydraulic fluid provided to the first and second hydraulic actuators;

an electronic controller configured to receive an operator flow command from an operator interface, the operator flow command having a first value, the electronic controller interfacing with the first and second electro-actuators of the first and second closed-center valve devices and with the pressure sensors, wherein in response to the operator flow command having the first value, the electronic controller is capable of commanding at least the first electro-actuator to provide different flow rates through the first closed-center valve device depending upon the sensed pressures;

the electronic controller including supervisory control logic configured to use the sensed pressures at the first and second hydraulic actuators to selectively prioritize one of the first and second hydraulic actuators over the other of the first and second hydraulic actuators to limit a sum of flow demands to the first and second valve devices; and wherein the electronic controller is configured to use the operator flow command and the sensed pressures to generate a pressure-modified flow command that is sent to one of the first and second closed-center valve devices to control flow through the one of first and second closed-center valve devices, and wherein the pressure-modified flow command corresponds to a pressure-modified flow rate that is less than a base flow rate which corresponds to the operator flow command;

wherein a magnitude of the pressure-modified flow rate commanded by the electronic controller for the operator flow command is inversely related to at least one of the sensed pressures.

7. The load dependent flow control system of claim 6, wherein the electronic controller commands the different flow rates dependent upon the sensed pressures only when at least one of the sensed pressures is over a threshold pressure.

* * * * *